US006602916B2

(12) United States Patent
Grundmann et al.

(10) Patent No.: US 6,602,916 B2
(45) Date of Patent: Aug. 5, 2003

(54) FOAMING APPARATUS AND METHOD

(75) Inventors: Steven R. Grundmann, Duncan, OK (US); Kenneth G. Neal, Duncan, OK (US)

(73) Assignee: Halliburton Energy Services, Inc, Duncan, OK (US)

( * ) Notice: Subject to any disclaimer, the term of this patent is extended or adjusted under 35 U.S.C. 154(b) by 58 days.

(21) Appl. No.: 09/932,603

(22) Filed: Aug. 17, 2001

(65) Prior Publication Data

US 2003/0045588 A1 Mar. 6, 2003

(51) Int. Cl.[7] ..... B01F 3/04; E21B 43/00

(52) U.S. Cl. ..... 516/10; 261/62; 261/76; 261/78.2; 261/DIG. 26; 239/343; 166/177.4

(58) Field of Search ..... 261/DIG. 26, 62, 261/76, 78.2; 516/10; 239/369, 101, 95, 96, 270, 343; 166/177.4

(56) References Cited

U.S. PATENT DOCUMENTS

| | | | | | |
|---|---|---|---|---|---|
| 556,921 | A | * | 3/1896 | Turner | 187/312 |
| 3,047,003 | A | * | 7/1962 | Gurney | 169/15 |
| 4,457,375 | A | | 7/1984 | Cummins | 166/309 |
| 4,470,727 | A | | 9/1984 | Ritter | 405/267 |
| 4,730,676 | A | | 3/1988 | Luers et al. | 166/309 |
| 4,780,243 | A | | 10/1988 | Edgley et al. | 516/11 |
| 4,797,003 | A | | 1/1989 | Cameron et al. | 366/101 |
| 4,830,794 | A | | 5/1989 | Edgley et al. | 261/62 |
| 5,356,565 | A | | 10/1994 | Southwell | 516/10 |
| 5,382,411 | A | | 1/1995 | Allen | 422/131 |
| 5,426,137 | A | | 6/1995 | Allen | 523/318 |
| 6,086,052 | A | * | 7/2000 | Rowe | 261/18.1 |

OTHER PUBLICATIONS

Halliburton brochure entitled "Tee Foam Generator (For Fracing and Cementing)", No. 84–9, Mar. 1984.

Halliburton Surface Manifold Equipment Catalog, pp. 8–1 through 8–3 (admitted to be prior art), Date unknown.

SPM Oilfield Specialty Products and Equipment brochure, dated 1987, Month unknown.

* cited by examiner

*Primary Examiner*—Daniel S. Metzmaier
(74) *Attorney, Agent, or Firm*—John W. Wustenberg; Warren B. Kice

(57) ABSTRACT

A foaming apparatus and method according to which a mixture of gas and a liquid is introduced into a vessel at a predetermined velocity and passes through a passage in the vessel. The flow of the mixture through the passage is increased to increase the velocity of the mixture and cause corresponding shearing forces on the mixture to create a turbulance and form foam from the mixture. The restrictor can be moved in the passage to vary the amount of restriction and therefore the amount of the foam.

6 Claims, 1 Drawing Sheet

FOAMING APPARATUS AND METHOD

BACKGROUND OF THE INVENTION

This invention relates to an apparatus and method for foaming a liquid/gas mixture.

Foamed liquids are often desirable in many applications such as, for example, the production of oil, gas or geothermal liquids from the earth. For example, a foamed cement slurry is often introduced in the annulus between the outer surface of a casing and the inner surface of a well to secure the casing in the well. The foam is usually produced by mixing a gas, such as nitrogen, with the cement slurry in a manner to form a foam and then introducing the mixture into the well.

In these arrangements, it is desirable to create a fine, textured foam by creating relatively high shearing forces on the liquid/gas mixture. However, in connection with cementing relatively shallow wells, the ultimate pressure of the cement slurry is relatively low and therefore the mass of the gas required to lighten the cement is also relatively low, which reduces the energy available to create the high shearing forces. Also, some previous attempts to form foamed cement slurries include discharging a gas, such as nitrogen, at a very high velocity, into a tee into which a cement is introduced in a flow path extending ninety degrees to the flow path of the nitrogen. However, the nitrogen must be discharged into the cement slurry at very high velocities to create shearing forces sufficient to produce a fine textured foam which renders it difficult to control the direction of the resulting nitrogen/cement slurry mixture. Producing the high pressure gas requires special and expensive pumping equipment not normally used in cementing operations.

SUMMARY

Therefore, according to an embodiment of the invention, a mixture of gas and a liquid is introduced into a vessel at a predetermined velocity and passes through a passage in the vessel. The flow of the mixture through the passage is increased to increase the velocity of the mixture and cause corresponding shearing forces on the mixture to create a turbulence and form foam from the mixture. The restrictor can be moved in the passage to vary the amount of restriction and therefore the amount of the foam.

DETAILED DESCRIPTION OF THE PREFERRED EMBODIMENT

Figure 1:
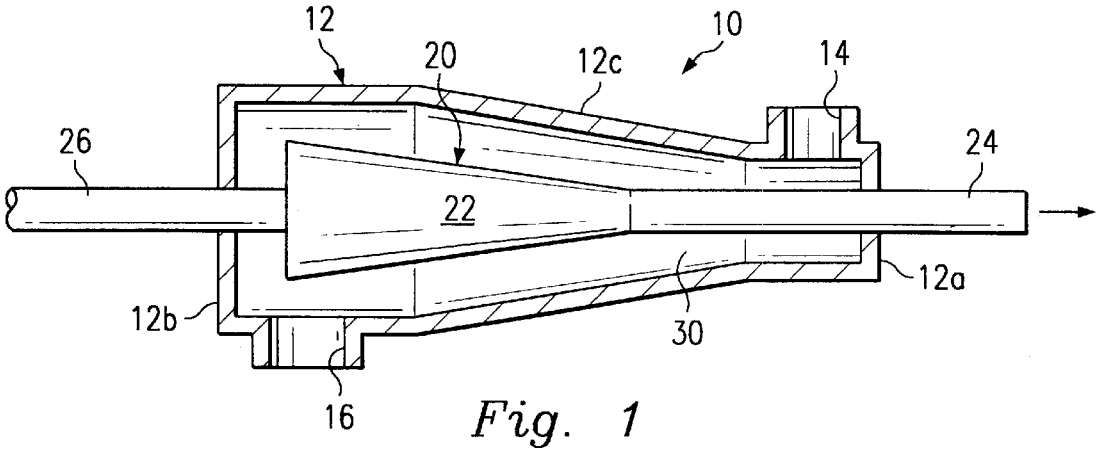
FIG. 1 is a cross-sectional view of an apparatus for foaming a liquid according to an embodiment of the invention.

Referring to FIG. 1 of the drawings, the reference numeral 10 refers, in general, to an apparatus for foaming a liquid according to an embodiment of the invention. For the purposes of example, the liquid will be described as a cement slurry of the type normally used in the production of oil, gas or geothermal liquids from the earth. The apparatus 10 includes an elongated pressure vessel 12 having a circular cross section and including two end walls 12*a* and 12*b*, a radially extending inlet 14 near the end wall 12*a*, and a radially extending outlet 16 near the end wall 12*b*. The remaining wall of the vessel 12 includes a frusto-conical portion 12*c* extending between the inlet 14 and the outlet 16.

A flow restrictor, in the form of a spool 20, is disposed in the vessel 12 with its longitudinal axis coinciding with the longitudinal axis of the vessel 12. The spool 20 consists of a frustro-conical base 22 and a cylindrical stem 24 extending from the smaller end of the base 22. The base 22 extends within the vessel 12 and the stem 24 has a portion extending in the vessel 12 and a portion projecting through an opening extending through the end wall 12*a* of the vessel 12. Preferably the stem 24 is formed integrally with the base 22.

A rod, or shaft, 26 extends through an opening in the end wall 12*b* of the vessel 12 and is connected, at one end, to the larger end of the base 22. It is understood that the other end of the rod 26 is connected to a device for applying a constant force to the rod 26 in an axial direction, which force is transmitted to the spool 20 in a direction shown by the arrow. A non-limiting example of this force-applying device is a pneumatic or hydraulic cylinder which is not shown since it is well known in the art. The force applying device could also be attached to the stem 24 at the other end of the vessel 12.

An annular passage 30 is formed between the outer surface of the spool 20 and the corresponding inner surface of the vessel 12, which passage forms a restricted flow path for a liquid introduced into the inlet 14 as will be described.

Due to the frusto-conical shape of the base 22 of the spool 20 and the wall 12*c* of the vessel 12, the cross-sectional area of the annular passage 30 can be varied by axial movement of the spool 20 in the vessel 12. Particularly, in the position of FIG. 1, the larger diameter portion of the base 22 of the spool 20 is axially aligned with the larger diameter portion of the wall 12*c* of the vessel 12, and the size of the restricted flow path is at a maximum. If the spool 20 is moved in a left-to-right direction, as viewed in the drawings, to the position of FIG. 2, the larger diameter portion of the base 22 is axially aligned with the smaller diameter portion of the of the wall 12*c*. The size of the annular passage 30 is thus reduced when compared to the position of FIG. 1. Of course, the precise location of the spool 20 in the vessel 12 is variable between the two positions of FIGS. 1 and 2 to vary the area of the annular passage 30 forming the restricted flow path.

Figure 2:
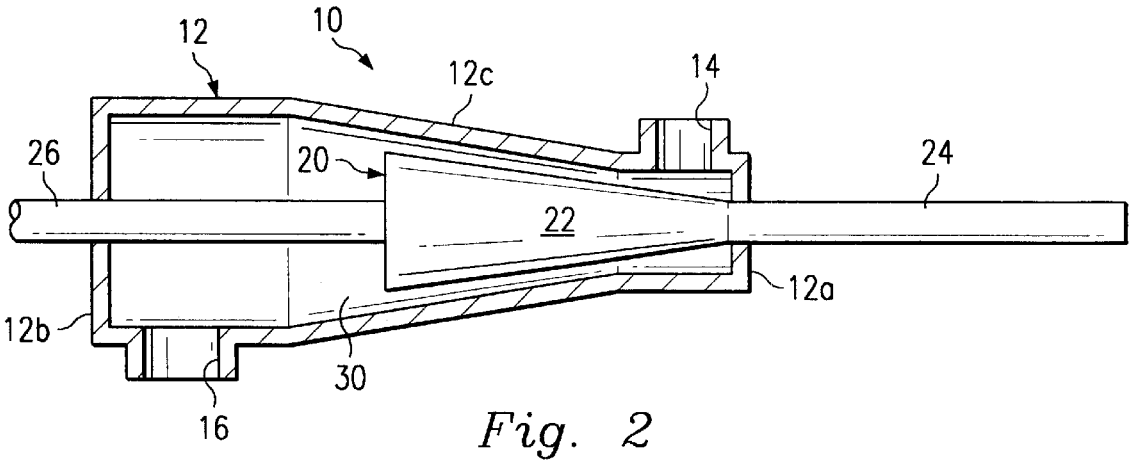
FIG. 2 is a view, similar to that of FIG. 1, but depicting the apparatus in a different operating mode.

FIG. 2 depicts the relatively small-diameter portion of the base 22 of the spool 20 abutting the inner surface of the end wall 12*a* defining the above-identified opening, which therefore limits the axial movement of the spool 20 in a left-to-right direction as viewed in the drawings. Similarly, movement of the spool 20 in a right-to-left direction, as viewed in the drawings will terminate when the large end of the base 22 engages the inner surface of the end wall 12*b*.

In operation, the spool 20 is located in a predetermined axial position in the vessel 12 and a constant force is applied to the spool 20 to maintain it in this position. A mixture of a liquid, such as a cement slurry, and a gas, such as nitrogen, is introduced into the inlet 14 in a radial direction relative to the vessel 12 and at a predetermined velocity. The mixture entering the vessel 12 encounters the restricted flow path formed by the annular passage 30 which significantly increases the velocity of the mixture and causes corresponding shearing forces on the mixture, with the resulting turbulence creating a foam from the liquid and gaseous components. The foamed mixture then discharges from the vessel 12 via the outlet 16, and can then be introduced into a wellbore, or the like, in connection with the recovery processes discussed above. Of course, the size of the restricted flow path formed by the annular passage 30, and therefore the degree of foaming, can be varied by moving the spool 20 axially relative to the vessel 12 in the manner discussed above.

Due to the constant force being applied on the spool 20 as described above, the pressure drop across the inlet 14 of the vessel 12 to the outlet 16 is substantially constant over a range of flow rates of the mixture through the vessel 12. Since a portion of the stem 24 extends out from the vessel 12 these pressure drops are independent of the pressure of the outlet 16.

Thus, the present apparatus and method enjoys several advantages. For example, the energy available to create the shearing forces to make the fine textured foam is relatively high. Also, the gas portion of the gas/cement slurry mixture does not have to be at high pressure relative to the liquid component of the mixture, which enables the direction of the mixture exiting the outlet 16 of the vessel 12 to easily be controlled.

It is understood that variations can be made in the foregoing without departing from the scope of the invention. For example, a gas other than nitrogen can be mixed with the cement and a liquid other than cement, can be used within the scope of the invention. Also the term "cement" and "cement slurry" as used above, is meant to cover mixtures of cement, water and/or other additives consistent with conventional downhole technologies. Further, the specific shape of the vessel 12 and the spool 20 can be varied as long as the cross-sectional area of the flow passage, and therefore the restriction, can be varied. For example, the vessel 12 can have a consistent cross section along its axis and the spool 20 can have a variable cross section, or vice versa; and, in fact other variable choke devices can be used.

Since other modifications, changes, and substitutions are intended in the foregoing disclosure, it is appropriate that the appended claims be construed broadly and in manner consistent with the scope of the invention.

What is claimed is:

1. A foaming apparatus comprising:

a vessel;

an inlet located on the vessel for receiving a mixture of gas and liquid;

an outlet located on the vessel for discharging the mixture, wherein the vessel defines a passage extending from the inlet to the outlet; and a spool disposed in the passage for restricting the flow of the mixture through the passage, wherein:

the spool is movable in the passage to vary the amount of restriction; and the spool has a frusto-conical portion having a first end that engages a first end of the vessel to limit movement of the spool in a first direction and a second end that engages a second end of the vessel to limit movement of the spool in a second direction.

2. The foaming apparatus of claim 1 wherein the vessel has a varying cross-sectional area such that movement of the spool in the passage varies the amount of the restriction.

3. The foaming apparatus of claim 2 further comprising a rod connected to the spool for moving the spool axially in the vessel to vary the amount of the restriction.

4. A method of generating foam, comprising the steps of:

introducing a mixture of gas and liquid into a vessel;

passing the mixture through a passage in the vessel;

restricting the flow of the mixture through the vessel to form foam using a spool disposed in the passage, wherein:

the spool is movable in the passage to vary the amount of restriction; and the spool has a frusto-conical portion having a first end that engages a first end of the vessel to limit movement of the spool in a first direction and a second end that engages a second end of the vessel to limit movement of the spool in a second direction.

5. The method of claim 4 further comprising the step of moving the spool in the passage to vary the amount of restriction.

6. The method of claim 5 wherein the step of moving the spool further comprises the step of connecting a rod to the spool for moving the spool in the passage.

* * * * *